United States Patent [19]

Wallis et al.

[11] Patent Number: 4,954,002

[45] Date of Patent: Sep. 4, 1990

[54] WRITING INSTRUMENT WITH MEMBRANE VENT AND THEIR MANUFACTURE

[75] Inventors: Philip Wallis, Newhaven, United Kingdom; Robert E. Burkhalter; Thomas D. Hall, both of Janesville, Wis.

[73] Assignee: Parker Pen (Benelux) B.V., Breda, Netherlands

[21] Appl. No.: 776,095

[22] Filed: Sep. 17, 1985

Related U.S. Application Data

[63] Continuation of Ser. No. 474,523, Mar. 11, 1983, abandoned.

[30] Foreign Application Priority Data

Mar. 16, 1982 [GB] United Kingdom ..... 8207675

[51] Int. Cl.[5] ..... B43K 7/00; B43K 5/00

[52] U.S. Cl. ..... 401/217; 401/135; 401/141; 401/242; 401/224

[58] Field of Search ..... 401/217, 242, 135, 141, 401/224

[56] References Cited

U.S. PATENT DOCUMENTS

| | | | |
|---|---|---|---|
| Re. 27,636 | 5/1973 | Horie | 401/217 |
| 511,134 | 12/1893 | Gilbert . | |
| 2,618,239 | 11/1952 | Tefft . | |
| 3,352,622 | 11/1967 | Schachter | 401/141 |
| 3,951,555 | 4/1976 | Wittnebert et al. | 401/217 |
| 4,108,559 | 8/1978 | Dick et al. | 401/217 |

FOREIGN PATENT DOCUMENTS

| | | | |
|---|---|---|---|
| 465591 | 3/1975 | Australia | 401/217 |
| 715042 | 9/1954 | United Kingdom | 401/217 |
| 1019675 | 2/1966 | United Kingdom . | |
| 1053750 | 1/1967 | United Kingdom . | |
| 1191674 | 5/1970 | United Kingdom . | |

*Primary Examiner*—Steven A. Bratlie

*Attorney, Agent, or Firm*—Foley & Lardner, Schwartz, Jeffery, Schwaab, Mack, Blumenthal & Evans

[57] ABSTRACT

In a writing instrument including an ink reservoir and an air hole, the air hole is spanned by a barrier formed as a porous non-absorbent ink repellent membrane of substantially uniform pore size. The barrier is non-porously sealed, for example by direct heating or ultrasonic welding, along its entire periphery to the wall of the air hole, the barrier allowing air to pass freely therethrough in both directions, but preventing escape of ink therethrough and therearound. The barrier is preferably formed of polytetrafluoroethylene with a pore radius of not more than 10 μm and a thickness of not more than 200 μm. The ink for use in the writing instrument preferably has a surface tension of not less than 30 mN $m^{-1}$, a viscosity of not more than 10 cp and a wetting angle with the barrier of not less than 100°.

21 Claims, 2 Drawing Sheets

WRITING INSTRUMENT WITH MEMBRANE VENT AND THEIR MANUFACTURE

This application is a continuation, of application Ser. No. 474,523, filed Mar. 11, 1983, now abandoned.

The present invention relates to writing instruments, of the kind including an air hole allowing ingress and egress of air to and from an ink reservoir, as well as to methods of making such writing instruments.

It is well known that, as a result of a temperature or pressure change, ink may be forced out of the reservoir. A collector for temporarily retaining this displaced ink is therefore usually provided. However, with excessive changes, such as repeated impacts, flicking, placing close to a radiator or altitude changes as experienced in flying, the collector is filled. Excess displaced ink is then ejected through the air hole. In the absence of a collector, displaced ink would be ejected directly through the air hole. This can cause considerable damage to clothing, if unexpected, and is in any event a nuisance and a waste of ink.

Many attempts have been made over the past 90 years or so to reduce leakage of ink through the air hole.

Initially, the attempts were rather crude and U.S. patent application Ser. No. 511,134 merely proposed the use of a perforated disc. The hope was that the perforations would allow air to enter the reservoir but the disc would retain ink within the reservoir. Even though this did not work, the same kind of arrangement was proposed in U.S. Pat. No. 2,618,239 with the proviso that the perforations would need to be sufficiently small, and the ink would need to be sufficiently viscous. More recently, U.S. Pat. No. 4,108,559 has acknowledged that ink seepage has still occurred through a variety of materials which are porous, rather than perforated, and has instead proposed a complicated braided bundle of filaments encased in an elongate sheath. It is thus clear that, although the theory of operation is well established, no practical and economic answer to the problem has been found.

The aim of the present invention is to provide such good immunity from leakage through the air hole, even by a low viscosity ink, that it is necessary to seal all other ink escape routes, except of course a writing tip, to prevent the air hole being by-passed.

A writing instrument, in accordance with a first aspect of the present invention, comprises an ink reservoir and an air hole, the air hole being spanned by a barrier formed as a porous non-absorbent ink repellent membrane of substantially uniform pore size non-porously sealed along its entire periphery to the wall of the hole, which barrier allows air to pass freely therethrough in both directions but prevents escape of ink therethrough and therearound.

Requiring the barrier to be porous (preferably a pore radius of not more than 10 $\mu$m), non-absorbent in that the pores remain empty when in contact with ink at normal operating pressures, ink repellent in that the wetting angle for ink on the barrier is greater than 90° (preferably not less than 100°) and of substantially uniform pore size rather than random pore sizes, allows the barrier to be as thin as a membrane (preferably not more than 200 $\mu$m).

The writing instrument is intended for use with an ink of high surface tension and low viscosity (preferably not less than 30 mN $m^{-1}$ and not more than 10 cp respectively) and can therefore be used with, merely as examples, an extruded plastics tip, a ball point or a fountain nib.

Preferably, the barrier is situated at the only point from which air can enter the reservoir or ink can escape from the writing instrument other than through its writing tip.

Other independently preferred embodiments are that:

- an ink feed to the writing tip is totally independent of ink flow to and from a collector;
- the only route for ink to and from capillary fins in the collector is through a weir;
- the ink feed and the collector are integrally or separately moulded of a plastics material such as polyethylene or acrylonitrile-butadiene-styrene;
- the air hole is constituted by a passageway which extends through the collector, if present, or through a casing to connect the reservoir to the atmosphere; or alternatively
- the reservoir includes a fibrous absorber.

The barrier presents a membrane which may be formed from microfibres which are fused together at their intersections. Such a membrane is available commercially under the trade name Mitex (RTM) from Millipore (UK) Ltd., of Abbey Road, London, England. Another suitable barrier is available commercially under reference SM 11842 from Sartorius Instruments Ltd., of Belmont, Surrey, England. These and other similar fluorinated polymeric membranes are marketed as filters for the purpose of removing solid particulate material from unidirectional fluid flow therethrough.

It may be thought that, in general terms, most porous materials (e.g. porcelain) can be used as a barrier to stop leakage of a fluid therethrough, while allowing free passage of air. Unless the fluid is mercury, for example, it will be absorbed in the pores of the barrier and will, sooner or later, saturate the barrier. There is then no further protection against leakage other than by normal capillary forces. Moreover, while the barrier is being saturated, there cannot be free passage of air through the barrier because the air first has to displace the fluid from the pores of the barrier. If used in a writing instrument, the lack of free passage of air to the reservoir will result in a reduction in the flow of ink to the writing tip. In the present invention, the porous material is also required to have a number of further physical characteristics so that ink will not penetrate the pores until a considerable pressure has been applied.

The head of liquid, corresponding to the pressure, required to force ink into the pores (assuming cylindrical capillaries) is given by the usual equation for capillary rise:

$$\Delta P = -\frac{2\sigma\cos\theta}{r}$$

where $\Delta P$ is the liquid head $\sigma$ is the surface tension of the liquid $\theta$ is the wetting angle r is the pore radius Preferably, the pore radius is small (e.g. 10 $\mu$m or less), the wetting angle is high (necessarily over 90° to be described as ink repellent), and the surface tension is high (e.g. 30 mN $m^{-1}$ or more), to increase the liquid head necessary to force ink into the pores.

For example, if the pore radius is 2.5 μm, the wetting angle is 100°, and the ink surface tension is 40 mN $m^{-1}$, the barrier will support a liquid head of 566 mm.

It will thus be clear that the present invention permits a high degree of immunity to be achieved from ink leakage. The immunity from leakage through the air hole may be so great that it is necessary to seal (e.g. by use of an adhesive) any other ink escape routes to prevent the air hole being by-passed. Indeed it is also important that the air hole be properly spanned and sealed on the periphery otherwise the barrier might itself be by-passed.

A method of making a writing instrument in accordance with a second aspect of the present invention comprises heat sealing the entire periphery of a barrier formed as a porous non-absorbent ink repellent membrane of substantially uniform pore size in such a manner that a central part of the barrier spans an air hole to allow air to pass freely therethrough in both directions but to prevent escape of ink from an ink reservoir with the peripheral part of the barrier being non-porously sealed to the wall of the hole.

Preferably, the act of applying heat causes a projecting seating to melt and permeate the pores at the periphery of the barrier. The best bond is produced by a thermoplastics material which is melted to a high temperature to produce low viscosity and is under a sealing pressure to induce good penetration. The melting of the seating can be induced either by directly heating or indirectly by for example welding ultrasonically. As integrity of the seal is of greater significance than its strength, the seating is preferably tapered, and is thinner nearer the barrier. The effective central area of the barrier (not obstructed by the heat sealing) is preferably between 0.25 $mm^2$ and 25 $mm^2$.

Two writing instruments and their methods of manufacture, in accordance with the present invention, will now be described, by way of example only, with reference to the accompanying drawings in which.

Figure 1:
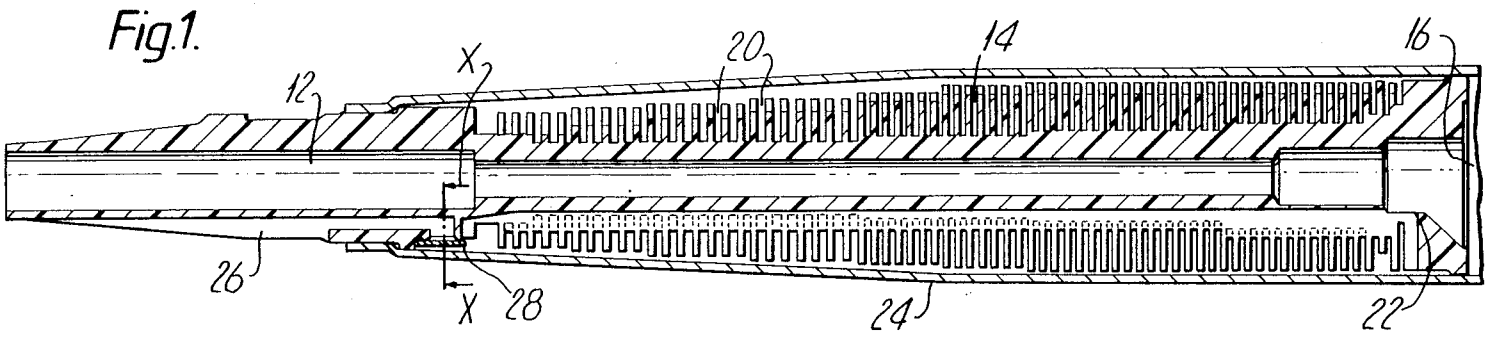
FIG. 1 is a longitudinal cross-section through a metal casing, a barrier and a plastics moulding forming part of a first writing instrument.
Figure 2:
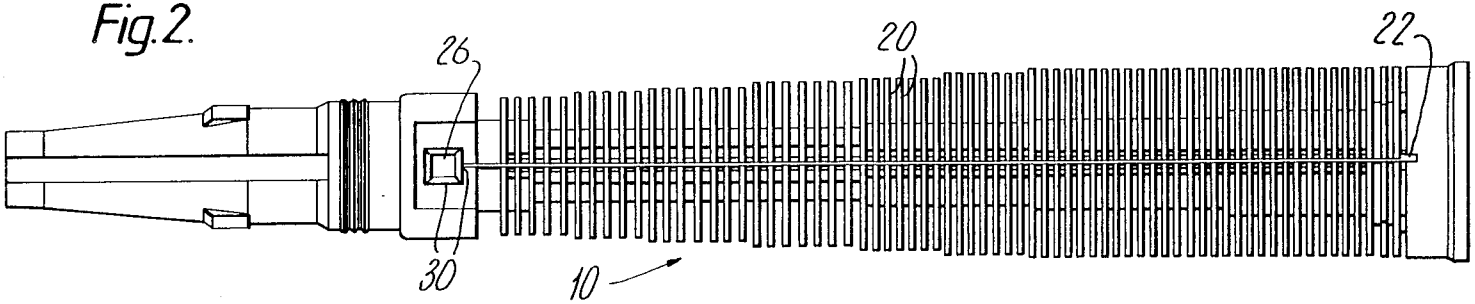
FIG. 2 is a side view of just the plastics moulding taken at 90° from FIG. 1.
Figure 4:
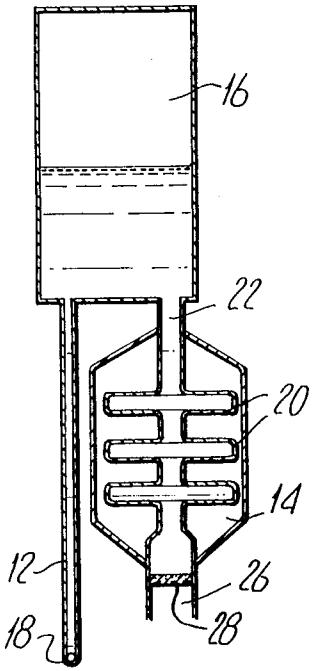
FIG. 4 is a schematic view indicating the operational relationship between various features of the first writing instrument.
Figure 3:
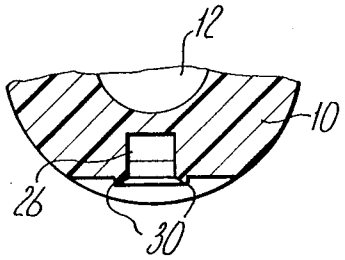
FIG. 3 is a transverse cross-section of just the plastics moulding taken along the line X—X of FIG. 1.

As the skilled reader will appreciate that FIGS. 1 to 4 of the accompanying drawings basically illustrate part of a known low viscosity ball point pen refill described more fully in our British Pat. No. 1 547 860 it will be necessary to describe only briefly its major components.

A one-piece polyethylene moulding 10 presents an ink feed channel 12 and a collector 14. As shown most clearly in FIG. 4, the ink feed channel 12 extends between a reservoir 16 and a point 18, and the collector 14 includes a plurality of parallel capillary fins 20 for retaining ink displaced from the reservoir 16 through a weir 22. There is no direct ink flow between the ink feed channel 12 and the collector 14. As shown most clearly in FIG. 1, the reservoir 16 is formed by a generally cylindrical metal casing 24 which is sealed by an adhesive such as an epoxy resin to the moulding 10 to enclose the collector 14. An air passageway 26 of square cross-section extends through the moulding 10 and opens on either side of the seal between the moulding 10 and the casing 24.

The air passageway 26 is spanned by a barrier 28 whose entire periphery is heat sealed to the moulding 10 so that a central part of the barrier 28 allows air to pass freely therethrough in both directions but ink is prevented from escaping from the reservoir 16 through and around the barrier 28.

The barrier 28 is formed of Millipore Mitex LS (RTM) with a nominal pore radius of 2.5 μm, a thickness of approximately 0.1 mm and an effective central area of 0.66 $m^2$. Side regions of the barrier 28 are sealed to an initially projecting seating 30 on the moulding 10 by the application of heat to the barrier 28. Before the heating starts, the seating 30 is thinner nearer the barrier 28. The barrier 28 could have different dimensions, lie in a different attitude, and be formed as a different porous hydrophobic polymeric homogeneous membrane, provided that its effect is as follows.

In use, ink having a viscosity less than 10 cp is withdrawn from the reservoir 16 during writing. Any ink in the collector 14 drains back through the weir 22 under the displacement action of air which can pass freely through the barrier 28. The weir 22 thus controls the ink feed pressure in the reservoir 16 in the normal way. In the event that the collector 14 is filled by ink, however, as a result of excessive temperature or pressure changes, the ink cannot penetrate the barrier 28 and thus cannot escape through the air passageway 26. Indeed, because the ink merely lies against the surface of the barrier 28, air passing through the barrier 28 does not need to displace any ink from the pores in the barrier 28, and the air therefore passes freely through the barrier 28.

It will be appreciated that, in the above-described example, the barrier 28 fulfills all of the following design criteria: it is situated such that the collector 14 is full before ink reaches it so as not to interfere with normal operation of the weir 22 and the collector 14; it represents the only route for air to move into and out of the reservoir 16; it represents the only possible exit for ink other than through the ink feed channel 12; it has a small pore size to give good leakage immunity yet sufficient air flow; it has a cross-sectional area sufficient to allow air flow at small pore size consistent with strength of material; it has a small thickness consistent with strength to allow use of small pore size without restricting air flow; and it is enclosed by the casing 24 to prevent physical damage and contamination which would affect its hydrophobic properties and hence its leakage resistance.

Figure 5:
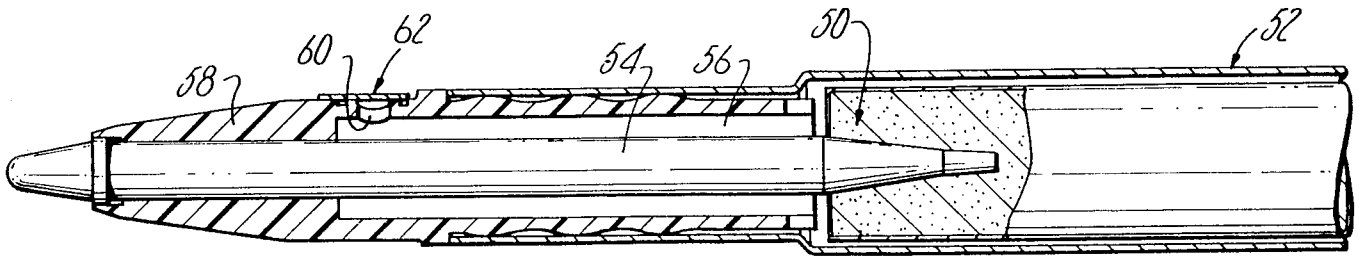
FIG. 5 is a longitudinal cross-section through a metal casing, a fibrous reservoir, an extruded plastics tip, a barrier and a nib holder forming part of a second writing instrument.

An alternative embodiment is illustrated in FIG. 5 including a fibrous reservoir 50 formed of for example cellulose acetate or polyethylene terephthalate located within a metal casing 52. An extruded tip 54 of polyacetal extends from the fibrous reservoir 50 and is supported within a central bore 56 of a nib holder 58 made of polyethylene. One end (right hand as shown) of the bore 56 is in communication with an air gap surrounding the fibrous reservoir 50, and the other end of the bore 56 is in communication with an air hole 60 leading to atmosphere.

A barrier 62 of Millipore Mitex LS (RTM) spans the air hole 60 and is heat sealed in a similar manner to that previously described to the nib holder 58 so that the central part of the barrier 62 allows air to pass freely therethrough in both directins but ink is prevented from escaping through and around the barrier 62.

As this embodiment has no collector, any low viscosity ink displaced from the fibrous reservoir 50, as a result of for example impact or sudden acceleration, will enter and fill the bore 56, but will then be prevented from escaping by the barrier 62.

It will be appreciated that the air hole 60, and thus the barrier 62, need not necessarily be located in the position shown, but could be located at any position such that it communicates with the air gap surrounding the fibrous reservoir 50.

We claim:

1. A writing instrument comprising an ink reservoir and an air hole, the air hole being spanned by barrier means, formed as a porous non-absorbent ink repellent membrane of substantially uniform pore size comprising a membrane formed from microfibers fixed together at their intersections, non-porously sealed along its entire periphery to the wall of the hole, for allowing the macroscopic flow of air therethrough in both directions while preventing the escape of ink therethrough and therearound.

2. A writing instrument according to claim 1, in which the barrier means is formed of a hydrophobic fluorinated polymeric material.

3. A writing instrument according to claim 2, in which the barrier means is formed of polytetrafluoroethylene.

4. A writing instrument according to claim 1, in which the pore radius of the barrier means is not more than 10 μm.

5. A writing instrument according to claim 1, in which the wetting angle for ink on the barrier means is not less than 100°.

6. A writing instrument according to claim 1, in which the thickness of the barrier means is not more than 200 μm.

7. A writing instrument according to claim 1, in which the effective central area of the barrier means is between 0.25 $mm^2$ and 25 $mm^2$.

8. A writing instrument according to claim 1, in which the surface tension and the viscosity of ink in the reservoir are respectively not less than 30 mN $m^{-1}$ and not more than 10 cp.

9. A method of making a writing instrument comprising heat sealing the entire periphery of a barrier formed as a macroscopically porous non-absorbent ink repellent membrane of substantially uniform pore size, comprising a membrane formed from microfibers fused together at their intersections, in such a manner that a central part of the barrier spans an air hole to allow air to pass freely therethrough in both directions but to prevent escape of ink from an ink reservoir with the peripheral part of the barrier being non-porously sealed to the wall of the hole.

10. A method according to claim 9, in which the act of applying heat causes a projecting seating to melt and permeate the pores at the periphery of the barrier.

11. A method according to claim 10, in which the projecting seating is tapered, before the heating starts, and is thinner nearer the barrier.

12. A method according to claim 9, in which sealing pressure is applied during the heating.

13. A method according to claim 9, in which all other routes, except a writing tip, through which ink could escape from the reservoir are sealed.

14. A method according to claim 13, in which the sealing of the other ink escape routes involves the use of an adhesive.

15. A method according to claim 9, in which the barrier is formed of a fluorinated material.

16. A method according to claim 15, in which the barrier is formed of polytetrafluoroethylene.

17. A method according to claim 9, in which the pore radius of the barrier is not more than 10 μm.

18. A method according to claim 9, in which the wetting angle for ink on the barrier is not less than 100°.

19. A method according to claim 9, in which the thickness of the barrier is not more than 200 μm.

20. A method according to claim 9, in which the effective central area of the barrier is between 0.25 $mm^2$ and 25 $mm^2$.

21. A method according to claim 9, in which the surface tension and the viscosity of ink in the reservoir are respectively not less than 30 mN $m^{-1}$ and not more than 10 cp.

* * * * *